US011250806B2

(12) United States Patent
Han et al.

(10) Patent No.: US 11,250,806 B2
(45) Date of Patent: Feb. 15, 2022

(54) COMMON VOLTAGE REGULATING CIRCUIT AND METHOD, DISPLAY DRIVING CIRCUIT AND DISPLAY DEVICE AVOIDING POWER-ON AFTERIMAGE

(71) Applicants: Hefei BOE Display Technology Co., Ltd., Anhui (CN); BOE Technology Group Co., Ltd., Beijing (CN)

(72) Inventors: Yizhan Han, Beijing (CN); Jianwei Sun, Beijing (CN); Liugang Zhou, Beijing (CN); Xiaolong Suo, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/768,273

(22) PCT Filed: Dec. 18, 2019

(86) PCT No.: PCT/CN2019/126286
§ 371 (c)(1),
(2) Date: May 29, 2020

(87) PCT Pub. No.: WO2020/140759
PCT Pub. Date: Jul. 9, 2020

(65) Prior Publication Data

US 2021/0225319 A1 Jul. 22, 2021

(30) Foreign Application Priority Data

Jan. 2, 2019 (CN) ..... 201910001971.0

(51) Int. Cl.
*G09G 3/36* (2006.01)

(52) U.S. Cl.
CPC ..... *G09G 3/3696* (2013.01); *G09G 2310/08* (2013.01); *G09G 2330/026* (2013.01)

(58) Field of Classification Search
CPC ..... G09G 3/36; G09G 3/3611; G09G 3/3614; G09G 3/3622; G09G 3/3625; G09G 3/364;
(Continued)

(56) References Cited

U.S. PATENT DOCUMENTS 10,902,803 B2 * 1/2021 Han ..... G09G 3/36
2005/0200588 A1 * 9/2005 Kaneda ..... G09G 3/3655 345/98
(Continued)

FOREIGN PATENT DOCUMENTS

CN 102054454 A 5/2011
CN 104199204 A 12/2014
(Continued)

OTHER PUBLICATIONS

Office Action dated Feb. 3, 2020 issued in corresponding Chinese Application No. 201910001971.0.

*Primary Examiner* — Alexander Eisen
*Assistant Examiner* — Nelson Lam
(74) *Attorney, Agent, or Firm* — Nath, Goldberg & Meyer; Joshua B. Goldberg

(57) ABSTRACT

The present disclosure provides a common voltage regulating circuit and a common voltage regulating method, a display driving circuit and a display device, the common voltage regulating circuit is applied to a display panel, and the display panel includes a pixel electrode and a common electrode, the common voltage regulating circuit includes: a first regulating sub-circuit configured to provide a signal from a second signal input terminal to a first signal output terminal under the control of an enabling signal terminal in
(Continued)

a power-on stage of the display panel; the first signal input terminal is configured to input a signal to be provided to the common electrode in a display stage of the display panel, the second signal input terminal is configured to input a signal to be provided to the pixel electrode in the power-on stage, the first signal output terminal is coupled with the common electrode.

19 Claims, 5 Drawing Sheets

(58) Field of Classification Search
CPC .. G09G 3/3644; G09G 3/3677; G09G 3/3681; G09G 3/3696; G09G 2310/08
USPC ..... 345/87–104
See application file for complete search history.

(56) References Cited

U.S. PATENT DOCUMENTS

2007/0001963 A1* 1/2007 Koma ..... G09G 3/3614 345/96
2007/0030231 A1* 2/2007 Lee ..... G09G 3/3696 345/94
2008/0224980 A1* 9/2008 Senda ..... G09G 3/3648 345/96
2009/0002303 A1* 1/2009 Huang ..... G09G 3/3696 345/89
2010/0033413 A1* 2/2010 Song ..... G09G 3/3655 345/89
2010/0097365 A1* 4/2010 Fang ..... G09G 3/3696 345/212
2010/0171775 A1* 7/2010 Sakamoto ..... G02F 1/134363 345/690
2013/0321494 A1* 12/2013 Takaki ..... G09G 3/3685 345/691
2013/0328855 A1* 12/2013 Li ..... G09G 3/3655 345/212
2014/0062990 A1* 3/2014 Zhang ..... G09G 3/3655 345/212
2015/0091954 A1* 4/2015 Ochiai ..... G11C 19/28 345/690
2016/0070147 A1* 3/2016 Kim ..... G02F 1/136286 345/96
2016/0180781 A1* 6/2016 Kim ..... G06F 3/04184 345/212
2016/0189642 A1* 6/2016 Shin ..... G09G 3/3655 345/690

FOREIGN PATENT DOCUMENTS

CN 105632435 A 6/2016
CN 106710566 A 5/2017
CN 109473078 A 3/2019
KR 10-2006-0019909 A 3/2006

* cited by examiner

COMMON VOLTAGE REGULATING CIRCUIT AND METHOD, DISPLAY DRIVING CIRCUIT AND DISPLAY DEVICE AVOIDING POWER-ON AFTERIMAGE

CROSS-REFERENCE TO RELATED APPLICATIONS

The present application is a U.S. National Stage Application under 35 U.S.C. § 371 of International Patent Application No. PCT/CN2019/126286, filed on Dec. 18, 2019, which claims priority to China Patent Application No. 201910001971.0 filed on Jan. 2, 2019, the disclosure of each of which are incorporated by reference herein in entirety.

TECHNICAL FIELD

Embodiments of the present disclosure relate to the field of display technology, in particular to a common voltage regulating circuit and a common voltage regulating method, a display driving circuit and a display device.

BACKGROUND

A liquid crystal display (LCD) as a flat panel display device, has characters of small size, low power consumption, no radiation, relatively low manufacturing cost and the like, so that it is increasingly applied in the field of high performance display. The liquid crystal display includes a display panel, and with development of display technology, the display panel has a larger and larger size.

It is found that a power-on afterimage may occur when the large-sized display panel is powered on, which causes a poor display effect of the display panel.

SUMMARY

Embodiments of the present disclosure provide a common voltage regulating circuit and a common voltage regulating method, a display driving circuit and a display device, which can avoid a power-on afterimage of a display panel and can improve a display effect of the display panel.

An embodiment of the present disclosure provides a common voltage regulating circuit for regulating a common voltage of a display panel, wherein the display panel includes a common electrode and a pixel electrode, the common voltage regulating circuit includes a first regulating sub-circuit. The first adjusting sub-circuit is respectively coupled with an enable signal terminal, a first signal input terminal, a second signal input terminal and a first signal output terminal, and is configured to provide a signal from the second signal input terminal to the first signal output terminal under the control of the enable signal terminal in a power-on stage of the display panel. The first signal input terminal is configured to input a signal to be provided to the common electrode in a display stage of the display panel, the second signal input terminal is configured to input a signal to be provided to the pixel electrode in the power-on stage of the display panel, the first signal output terminal is coupled to the common electrode.

In some implementations, the first regulating sub-circuit is further configured to provide, under the control of the enable signal terminal, a signal from the first signal input terminal to the first signal output terminal in the display stage of the display panel.

In some implementations, the common voltage regulating circuit further includes: an identification sub-circuit and a second regulating sub-circuit, wherein the second signal input terminal is further configured to input a signal to be provided to the pixel electrode in a power-off stage of the display panel. The identification sub-circuit is respectively coupled with N clock signal terminals and is configured to identify whether the display panel is in the power-off stage according to clock signals of the N clock signal terminals, and output a control signal in response to an identification result indicating that the display panel is in the power-off stage, wherein N is an integer larger than or equal to 2. The second regulating sub-circuit is respectively coupled to the identification sub-circuit, the second signal input terminal, a third signal input terminal, a reference signal terminal and a second signal output terminal, and is configured to regulate, under the control of the control signal, a signal from the third signal input terminal according to signals from the second signal input terminal, the third signal input terminal and the reference signal terminal, until a voltage difference between the regulated signal from the third signal input terminal and the signal from the second signal input terminal is less than or equal to a voltage of a signal from the reference signal terminal, and is further configured to provide the regulated signal from the third signal input terminal to the second signal output terminal. The common electrode is coupled with the third signal input terminal and the second signal output terminal, respectively.

In some implementations, the first regulating sub-circuit is coupled to the identification sub-circuit and configured to output no signal under the control of the control signal.

In some implementations, the first regulating sub-circuit includes a data selector. The data selector includes a first control terminal, a first input terminal, a second input terminal, a third input terminal and a first output terminal, and the first control terminal, the first input terminal, the second input terminal and the third input terminal of the data selector are respectively coupled with the identification sub-circuit, the enable signal terminal, the first signal input terminal and the second signal input terminal, and the first output terminal of the data selector is coupled with the first signal output terminal.

In some implementations, the identification sub-circuit includes an AND gate circuit, the AND gate circuit includes a plurality of input terminals and one output terminal, the input terminals of the AND gate circuit are respectively coupled with the N clock signal terminals, and the output terminal of the AND gate circuit is respectively coupled with the control terminal of the data selector and the second regulating sub-circuit.

In some implementations, the second regulating sub-circuit includes a subtracter, a comparator and a voltage regulator. The subtractor includes a second control terminal, a fourth input terminal, a fifth input terminal and a second output terminal, and the comparator includes a sixth input terminal, a seventh input terminal and a third output terminal; the voltage regulator includes an eighth input terminal, a ninth input terminal, a fourth output terminal and a fifth output terminal. The second control terminal of the subtracter is coupled with the output terminal of the AND gate circuit and is configured to receive the control signal output by the AND gate circuit. The fourth input terminal of the subtractor is coupled to the second signal input terminal, the fifth input terminal of the subtractor is coupled to the third signal input terminal, the second output terminal of the subtractor is coupled to the sixth input terminal of the comparator, and the subtractor is configured to be started under the control of the control signal. The seventh input terminal of the comparator is coupled with the reference signal terminal. The third output terminal of the comparator is coupled with the voltage regulator. The eighth input terminal of the voltage regulator is coupled with the second output terminal of the subtracter. The ninth input terminal of the voltage regulator is coupled with the third output terminal of the comparator. The fourth output terminal of the voltage regulator is coupled with the third signal input terminal. The fifth output terminal of the voltage regulator is coupled with the second signal output terminal.

An embodiment of the present disclosure provides a display driving circuit, including: a timing control circuit, a level conversion circuit, a power management integrated circuit, and the common voltage regulating circuit described above, the common voltage regulating circuit is respectively coupled with the timing control circuit, the level conversion circuit and the power management integrated circuit.

In some implementations, the timing control circuit is coupled to the enable signal terminal for providing a signal to the enable signal terminal; the level conversion circuit is coupled with the N clock signal terminals and is configured to provide clock signals to the N clock signal terminals; the power management integrated circuit is coupled to the first signal input terminal and the second signal input terminal, and is configured to input, to the first signal input terminal, a signal to be provided to the common electrode in a display stage of the display panel, and is further configured to input a signal to be provided to the pixel electrode in a power-on stage and a power-off stage of the display panel.

An embodiment of the present disclosure provides a display device, including the display driving circuit described above.

An embodiment of the present disclosure provides a common voltage regulating method applied to the common voltage regulating circuit described above, the common voltage regulating method includes: in a power-on stage of the display panel, providing, by the first regulating sub-circuit, a signal from the second signal input terminal to the first signal output terminal under the control of the enable signal terminal.

In some implementations, the common voltage regulating method further includes: in a display stage of the display panel, providing, by the first regulating sub-circuit, a signal from the first signal input terminal to the first signal output terminal under the control of the enable signal terminal.

In some implementations, the common voltage regulating circuit further includes: an identification sub-circuit and a second regulating sub-circuit, wherein the second signal input terminal is further configured to input a signal to be provided to the pixel electrode in a power-off stage of the display panel; the identification sub-circuit is respectively coupled with N clock signal terminals, wherein N is an integer larger than or equal to 2; the second regulating sub-circuit is respectively coupled with the identification sub-circuit, the second signal input terminal, the third signal input terminal, the reference signal terminal and the second signal output terminal, and the common voltage regulating method further includes: identifying, by the identification sub-circuit, whether the display panel is in the power-off stage, according to clock signals of the N clock signal terminals; outputting, by the identification sub-circuit, a control signal in response to that the display panel is in the power-off stage, so that the first regulating sub-circuit outputs no signal under the control of the control signal; and regulating, by the second regulating sub-circuit, the signal from the third signal input terminal according to the signals from the second signal input terminal, the third signal input terminal and the reference signal terminal under the control of the control signal, until a voltage difference between the regulated signal from the third signal input terminal and the signal from the second signal input terminal is less than or equal to a voltage of the signal from the reference signal terminal, and outputting, by the second regulating sub-circuit, the regulated signal from the third signal input terminal to the second signal output terminal.

In some implementations, the identifying, by the identification sub-circuit, whether the display panel is in the power-off stage, according to the clock signals of the N clock signal terminals includes: judging, by the identification sub-circuit, whether all the clock signals of the N clock signal terminals are at a high level, and in response to that all the clock signals of the N clock signal terminals are at the high level, the display panel is in the power-off stage.

In some implementations, the regulating, by the second regulating sub-circuit, the signal from the third signal input terminal according to the signals from the second signal input terminal, the third signal input terminal and the reference signal terminal under the control of the control signal includes: making the second regulating sub-circuit start to operate under the control of the control signal, obtaining the voltage difference according to the voltages of the signals of the second signal input terminal and the third signal input terminal, comparing the voltage difference with the voltage of the signal of the reference signal terminal, and regulating, by the second regulating sub-circuit, the signal from the third signal input terminal according to the voltage difference in response to that the voltage difference is larger than the voltage of the signal of the reference signal terminal.

DESCRIPTION OF DRAWINGS

The accompanying drawings are included to provide a further understanding of the embodiments of the present disclosure and constitute a part of the specification, for illustrating technical solutions of the present disclosure together with the embodiments, and do not limit the technical solutions of the present disclosure.

DESCRIPTION OF EMBODIMENTS

To make objects, technical solutions and advantages of the present disclosure more apparent and clear, embodiments of the present disclosure will be described in detail below with reference to the accompanying drawings. It should be noted that the embodiments and features of the embodiments in the present disclosure may be arbitrarily combined with each other without conflict.

Steps illustrated in the flowchart of the drawings may be performed in a computer system executing a set of computer-executable instructions. Also, although a logical order is shown in the flowchart, in some cases, the steps shown or described may be performed in an order different from that shown here.

Unless otherwise defined, technical or scientific terms used in the embodiments of the present disclosure should have the ordinary meaning as understood by any ordinary skill in the art to which the present disclosure belongs. The use of "first", "second" and similar terms in the embodiments of the present disclosure is not intended to indicate any order, quantity, or importance, but rather is used to distinguish one element from another. The word "comprising", "including", or the like indicates that an element or item preceding thereto contains the element or item listed after the word and its equivalent, without excluding other elements or items. The terms "connecting", "coupling" or the like is not restricted to physical or mechanical connections, but may include electrical connections, whether direct or indirect. "Upwards", "downwards", "leftwards", "rightwards", and the like are used merely to indicate relative positional relationships, and when an absolute position of the object being described is changed, the relative positional relationships may be changed accordingly.

Figure 1A:
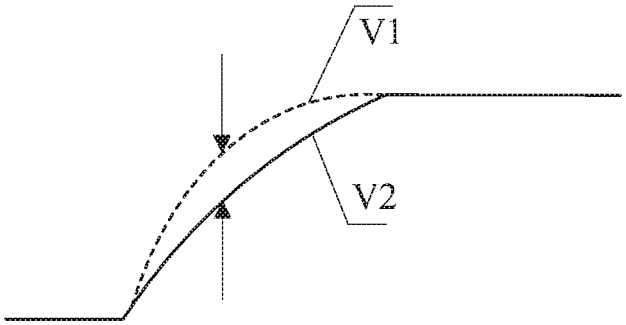
FIG. 1A is a diagram illustrating a relationship between a common voltage and a pixel voltage when a display panel is powered on in the related art.

FIG. 1A is a schematic diagram illustrating a relationship between a common voltage and a pixel voltage when a display panel is powered on in the related art, as shown in FIG. 1A, in the related art, when a large-sized display panel is in a power-on stage, a voltage difference between a voltage V1 of a signal provided to the common electrode and a voltage V2 of a signal provided to the pixel electrode is relative large, and the voltage difference changes with time, resulting in a power-on afterimage, where the power-on afterimage mainly represents that a picture is slowly displayed when the display panel is powered on.

Figure 1B:
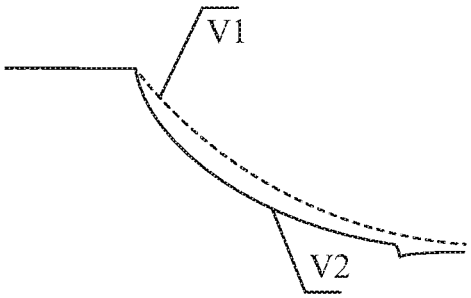
FIG. 1B is a diagram illustrating a relationship between a common voltage and a pixel voltage when a display panel is powered off in the related art.
Figure 1C:
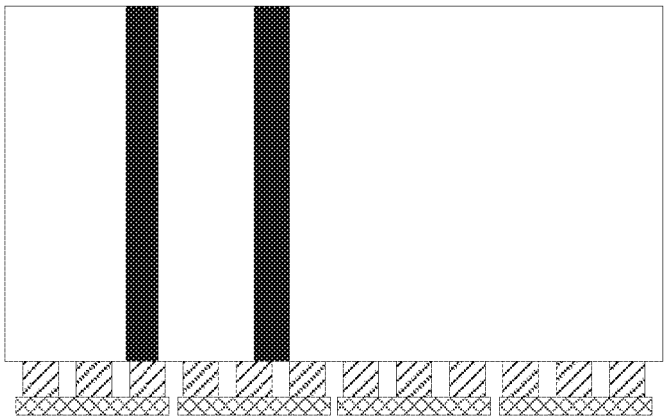
FIG. 1C is a schematic diagram of a power-off vertical block in the related art.

In addition, FIG. 1B is a schematic diagram of a relationship between the common voltage and the pixel voltage when the display panel is powered off in the related art, as shown in FIG. 1B, in the related art, when the large-sized display panel is in a power-off stage, a voltage V1 of the common electrode is powered down slowly due to an existence of capacitance, so that a certain voltage difference exists between the voltage V1 of the common electrode and the voltage V2 of the pixel electrode, and the luminance of the display panel is not uniform, thereby presenting a bad phenomenon of power-off vertical block, where the power-off vertical block mainly represents a black vertical block, having a color different from that of a peripheral area, in a partial region of the display panel in the power-off stage, and FIG. 1C shows power-off vertical blocks in the related art.

In order to solve the problem of power-on afterimage, embodiments of the present disclosure provide a common voltage regulating circuit and a common voltage regulating method, a display driving circuit, and a display device, which are specifically described as follows.

Figure 2:
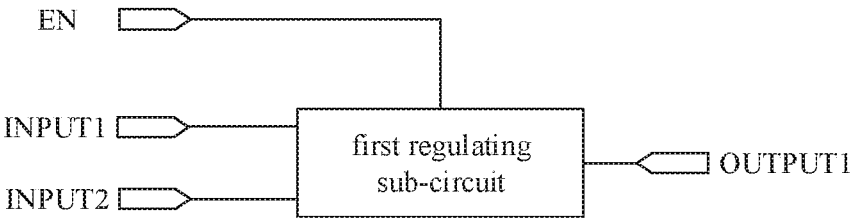
FIG. 2 is a schematic structural diagram of a common voltage regulating circuit according to an embodiment of the present disclosure.

An embodiment of the present disclosure provides a common voltage regulating circuit applied to a display panel, the display panel includes a common electrode and a pixel electrode, FIG. 2 is a schematic structural diagram of a common voltage regulating circuit provided in the present embodiment, and as shown in FIG. 2, the common voltage regulating circuit provided in the present embodiment includes a first regulating sub-circuit.

Specifically, the first regulating sub-circuit is coupled to an enable signal terminal EN, a first signal input terminal INPUT1, a second signal input terminal INPUT2, and a first signal output terminal OUTPUT1, respectively, receives signals input from the first signal input terminal INPUT1 and the second signal input terminal INPUT2, and outputs a signal to the first signal output terminal OUTPUT1. More specifically, the first regulating sub-circuit is further configured to output the signal input from the second signal input terminal INPUT2 to the first signal output terminal OUTPUT1 under the control of the enable signal terminal EN when the display panel is in the power-on stage.

The first signal input terminal INPUT1 is configured to input a signal to be provided to the common electrode during a display stage of the display panel, the second signal input terminal INPUT2 is configured to input a signal to be provided to the pixel electrode during a power-on stage of the display panel, and the first signal output terminal OUTPUT1 is coupled to the common electrode. It should be noted that, during the power-on stage, the first signal input terminal OUTPUT1 is configured to provide the signal from the first signal output terminal OUTPUT1 to the common electrode.

The display panel is driven by a driving circuit to perform displaying, the driving circuit includes: a power management integrated circuit and a timing control circuit. Specifically, the signal input by the enable signal terminal EN is generated by the timing control circuit, and the signals input by the first signal input terminal INPUT1 and the second signal input terminal INPUT2 are generated by the power management integrated circuit. Specifically, the first signal input terminal INPUT1 inputs signals only in the power-on stage and the display stage, and does not input any signal during the power-off stage. The signal input by the second signal input terminal INPUT2 in the power-on stage is a half-analog voltage (HAVDD) signal which can be used as Gamma reference voltage.

In the present embodiment, when the display panel is in the power-on stage, the signal input by the enable signal terminal EN is at a high level. In some implementations, the signal from the enable signal terminal EN may be a LOCKN signal generated by the timing control circuit, and when the LOCKN signal is at a high level, the first regulating sub-circuit outputs the signal from the second signal input terminal OUTPUT2 to the common electrode, so that the signal provided to the common electrode is the same as the signal provided to the pixel electrode, and at this time, the display panel displays a full black picture to avoid the power-on afterimage.

Figure 3:
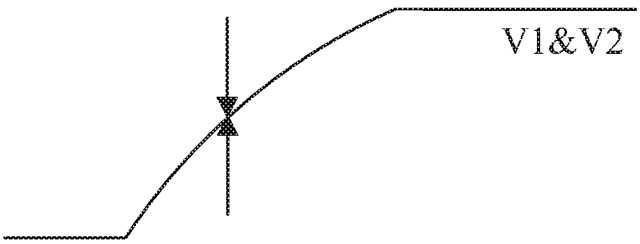
FIG. 3 is a schematic diagram of a relationship between a common voltage and a pixel voltage in a power-on stage according to an embodiment of the present disclosure.

FIG. 3 is a schematic diagram of a relationship between a common voltage and a pixel voltage in the power-on stage according to an embodiment of the disclosure, and as shown in FIG. 3, a voltage V1 (i.e., a common voltage) of the signal provided to the common electrode is the same as a voltage V2 of the signal provided to the pixel electrode. The first regulating sub-circuit provided by the embodiment of the present disclosure pulls the common voltage to the voltage of the pixel electrode in the power-on stage of the display panel to realize zero voltage difference.

The common voltage regulating circuit provided by the embodiment is applied to a display panel, and the display panel includes a common electrode and a pixel electrode, the common voltage regulating circuit includes a first regulating sub-circuit, which is respectively coupled with the enable signal terminal, the first signal input terminal, the second signal input terminal and the first signal output terminal and is configured to provide the signal from the second signal input terminal to the first signal output terminal under the control of the enable signal terminal when the display panel is in the power-on stage; the first signal input terminal is configured to input the signal to be provided to the common electrode in the display stage of the display panel, the second signal input terminal is configured to input the signal to be provided to the pixel electrode in the power-on stage of the display panel, and the first signal output terminal is coupled to the common electrode. The common electrode voltage regulating circuit provided by the present embodiment provides the signal from the second signal input terminal to the common electrode in the power-on stage of the display panel, so that the voltage of the signal provided to the common electrode is the same as the voltage of the signal provided to the pixel electrode, the power-on afterimage phenomenon caused by the voltage difference between the signal of the common electrode and the signal of the pixel electrode can be avoided, and the display effect of the display panel is improved.

In some implementations, the first regulating sub-circuit is further configured to provide the signal from the first signal input terminal to the first signal output terminal under the control of the enable signal terminal when the display panel is in the display stage.

Specifically, when the display panel is in the display stage, the signal of the enable signal terminal EN is at a low level, it should be noted that when the LOCKN signal is at the low level, the timing control circuit starts to operate normally, and at this time, the first regulating sub-circuit outputs a signal required by the common electrode when the display panel is in the display stage, that is, the signal from the first signal input terminal.

Figure 4:
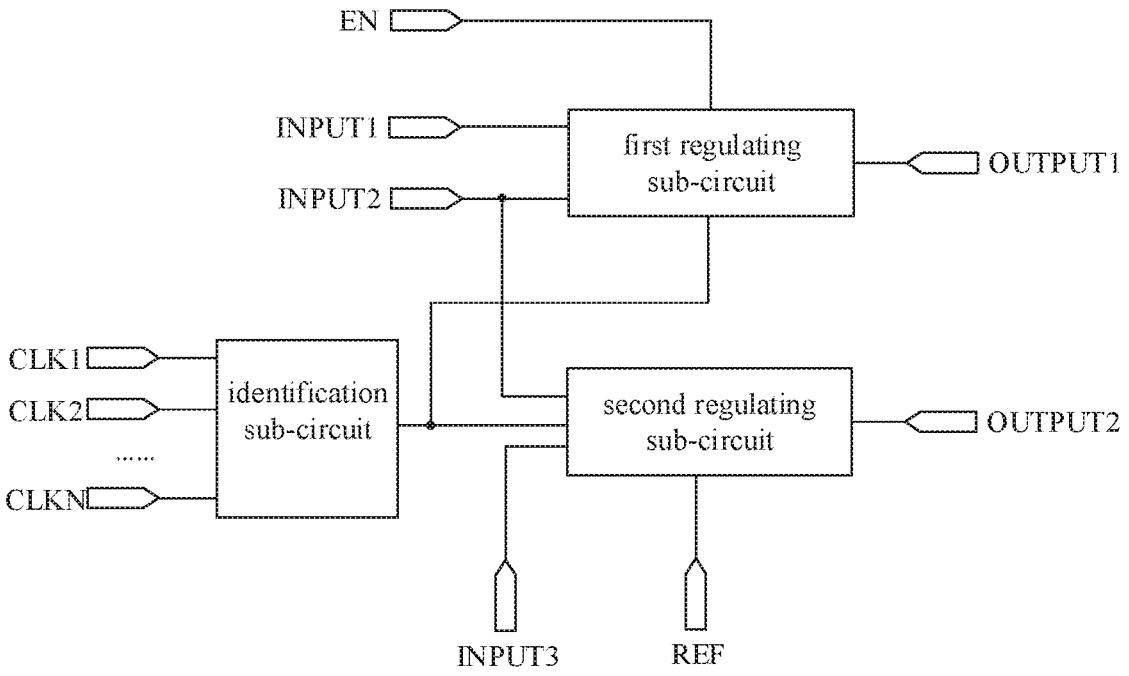
FIG. 4 is another schematic structural diagram of a common voltage regulating circuit according to an embodiment of the present disclosure.

In some implementations, in order to overcome the defect of the power-off vertical block occurring in the power-off stage of the large-sized display panel, an embodiment of the present disclosure provides another common voltage regulating circuit as shown in FIG. 4, and as shown in FIG. 4, in addition to the first regulating sub-circuit as described above, the common voltage regulating circuit provided by the present embodiment further includes: an identification sub-circuit and a second regulating sub-circuit, the second signal input terminal INPUT2 is further configured to input the signal to be provided to the pixel electrode during the power-off stage of the display panel.

Specifically, input terminals of the identification sub-circuit are coupled to N clock signal terminals CLK1, CLK2, . . . , CLKN, respectively, for identifying whether the display panel is in the power-off stage according to clock signals of the N clock signal terminals CLK1, CLK2, . . . , CLKN, and when the display panel is in the power-off stage, the identification sub-circuit outputs a control signal. A control terminal, a first input terminal, a second input terminal, a third input terminal and an output terminal of the second regulating sub-circuit are coupled to an output terminal of the identification sub-circuit, the second signal input terminal INPUT2, the third signal input terminal INPUT3, a reference signal terminal REF and the second signal output terminal OUTPUT2, respectively, for regulating, under the control of the control signal received from the identification sub-circuit via the control terminal, a signal input from the third signal input terminal INPUT3 based on the signals from the second signal input terminal INPUT2, the third signal input terminal INPUT3 and the reference signal terminal REF, until the voltage difference between the regulated signal from the third signal input terminal INPUT3 and the signal from the second signal input terminal INPUT2 is less than or equal to a voltage of the signal at the reference signal terminal REF, and further for supplying the regulated signal from the third signal input terminal INPUT3 to the second signal output terminal OUTPUT2.

In the present embodiment, the common electrode is coupled to the third signal input terminal and the second signal output terminal, respectively.

It should be noted that, during the power-off stage of the display panel, the common electrode discharges slowly, the third signal input terminal is configured to provide the voltage of current signal of the common electrode, and in addition, during the power-off stage, in order to release electric charges in pixel units, the signal provided to the pixel electrode is the HAVDD signal.

Specifically, the identification sub-circuit is specifically configured to determine whether all the clock signals of the N clock signal terminals are at the high level, and the display panel is in the power-off stage when all the clock signals of the N clock signal terminals are at the high level.

In some implementations, N is an integer greater than or equal to 2, a value of N is the same as the number of clock signals generated by the timing control circuit, and is determined specifically according to an actual requirement, which is not limited in the present embodiment of the present disclosure.

In the present embodiment, as shown in FIG. 4, the first regulating sub-circuit is coupled to the identification sub-circuit, and is configured to output no signal under the control of the control signal.

The first regulating sub-circuit provided by the present embodiment outputs signals in both the power-on stage and the display stage, and does not output any signal in the power-off stage.

In the present embodiment, the identification sub-circuit is used to identify a power-off action to avoid misoperation. In addition, in order to avoid an abnormal picture caused by instantaneously pulling the signal of the common electrode to the signal of the pixel electrode, the embodiment adopts a step-type following ode to performing the pulling.

Figure 5:
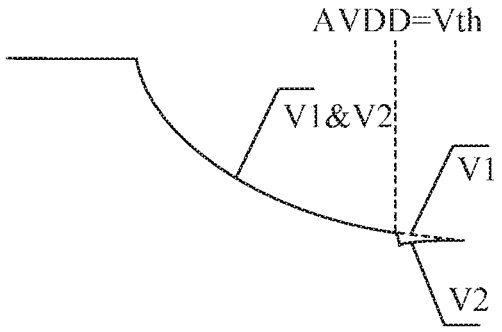
FIG. 5 is a schematic diagram of a relationship between a common voltage and a pixel voltage in a power-off stage according to an embodiment of the present disclosure.

FIG. 5 is a schematic diagram of a relationship between a common voltage and a pixel voltage during a power-off stage according to an embodiment of the disclosure, and as shown in FIG. 5, the identification sub-circuit and the second regulating sub-circuit provided in the present embodiment are configured to: in the power-off stage, when the analog voltage AVDD is relative large, a signal the same as that of the pixel electrode is provided to the common electrode, when the analog voltage AVDD is lower than a certain threshold voltage Vth, some of field effect transistors are turned off, so that the signal provided to the pixel electrode corresponding to the turned off field effect transistors is separated from the HAVDD, at this time, the signal of the common electrode and the signal of the pixel electrode are both relative low, so that the voltage difference between the signal of the common electrode and the signal of the pixel electrode is relative small, the voltage difference between the signal of the common electrode and the signal of the pixel electrode in the power-off stage is reduced, and the defect of power-off vertical blocks is effectively improved.

Figure 6:
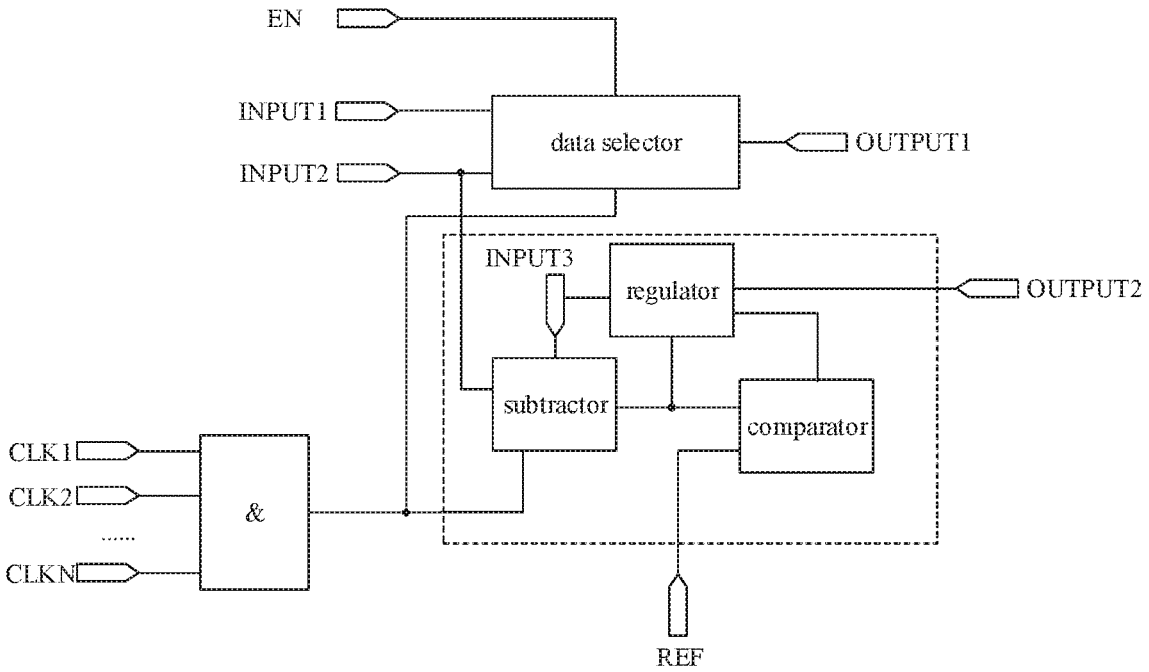
FIG. 6 is an equivalent circuit diagram of a common voltage regulating circuit provided by an embodiment of the present disclosure.

FIG. 6 is an equivalent circuit diagram of a common voltage regulating circuit according to an embodiment of the present disclosure, and as shown in FIG. 6, the first regulating sub-circuit includes a data selector, the identification sub-circuit includes an AND gate circuit, the second regulating sub-circuit includes a subtracter, a comparator and a voltage regulator.

The data selector includes a control terminal, a first input terminal, a second input terminal, a third input terminal and an output terminal, the control terminal, the first input terminal, the second input terminal and the third input terminal of the data selector are respectively coupled with the identification sub-circuit, the enable signal terminal EN, the first signal input terminal INPUT1 and the second signal input terminal INPUT2, and the output terminal of the data selector is coupled with the first signal output terminal OUTPUT1.

Specifically, the data selector is an electronic device including at least an AND gate and a switch, and the structure and principle thereof are common technologies for those skilled in the art, and are not described in detail herein.

The identification sub-circuit includes multiple AND gate circuits, input terminals of the multiple AND gate circuits are coupled with N clock signal terminals CLK1, CLK2, . . . , CLKN, output terminals of the multiple AND gate circuits are coupled with the first regulating sub-circuit and the second regulating sub-circuit so as to output a control signal to the first regulating sub-circuit and the second regulating sub-circuit.

The subtractor is started to operate under the control of the control signal, a first input terminal of the subtractor is coupled with the second signal input terminal INPUT2, a second input terminal of the subtractor is coupled with the third signal input terminal INPUT3, and an output terminal of the subtractor is coupled with a first input terminal of the comparator; a second input terminal of the comparator is coupled with the reference signal terminal REF, and an output terminal of the comparator is coupled with the second signal output terminal OUTPUT2; an input terminal of the voltage regulator is coupled with the output terminal of the subtracter, a first output terminal of the voltage regulator is coupled with the third signal input terminal INPUT3, and a second output terminal of the voltage regulator is coupled with the second signal output terminal OUTPUT2.

Specifically, the subtractor is turned on under the control of the control signal, a voltage difference is obtained according to the voltages of the signals of the second signal input terminal INPUT2 and the third signal input terminal INPUT3, the comparator compares the voltage difference with the voltage of the signal of the reference signal terminal, the voltage regulator regulates the signal of the third signal input terminal INPUT3 according to the voltage difference when the voltage difference is greater than the voltage of the signal of the reference signal terminal REF, until the voltage difference between the signal of the second signal input terminal INPUT2 and the regulated signal of the third signal input terminal INPUT3 is smaller than or equal to the voltage of the signal of the reference signal terminal, and the voltage regulator outputs the regulated signal of the third signal input terminal INPUT3 to the second signal output terminal OUTPUT2.

Specifically, in the power-off stage of the display panel, the control signal output by the identification sub-circuit is at a high level, the second regulating sub-circuit is started to operate, and the voltage regulator is configured to boost or reduce the voltage of the signal of the common electrode according to the output of the subtractor.

The voltage regulator may be implemented by using a circuit in the related art, which is not limited in the embodiment of the present disclosure.

The working principle of the common voltage regulating circuit provided by the embodiment of the present disclosure is further described below, specifically: the first regulating sub-circuit provides the signal to be provided to the pixel electrodes to the common electrode under the control of the enable signal terminal, so that the signal of the common electrode is the same as the signal of the pixel electrode, the first regulating sub-circuit provides a required signal to the common electrode in the display stage of the display panel, so that the display panel displays normally, the identification sub-circuit judges whether the clock signals of the N clock signal terminals are all at the high level, and determines that the display panel is in the power-off stage and outputs the control signal in response to that the clock signals are all at the high level; the second regulating sub-circuit is started to operate under the control of the control signal, obtains the voltage difference according to the voltages of the signals of the second signal input terminal and the third signal input terminal, compares the voltage difference with the voltage of the signal of the reference signal terminal, and regulates the signal of the third signal input terminal according to the voltage difference in response to that the voltage difference value is greater than the voltage of the signal of the reference signal terminal, until the voltage difference value between the regulated signal of the third signal input terminal and the signal of the second signal input terminal is smaller than or equal to the voltage of the signal of the reference signal terminal, and outputs the regulated signal from the third signal input terminal to the second signal output terminal, thus gradually pulling the signal of the common electrode to the signal of the second signal input terminal in the power-off stage.

By adding the common voltage regulating circuit to control the signals provided to the common electrode during the power-on and power-off stages, the embodiment of the present disclosure can effectively avoid the defect of power-on afterimage and power-off vertical blocks, improve the display effect of the display panel, has a wide application range, and is applicable to various display panels without need of readjusting the circuit elements due to process fluctuation.

Based on the same inventive concept, an embodiment of the present disclosure further provides a common voltage regulating method, which is applied to the common voltage regulating circuit described with reference to FIG. 2, and the common voltage regulating method specifically includes the following step S1.

In step S1, when the display panel is in the power-on stage, the first regulating sub-circuit provides the signal from the second signal input terminal to the first signal output terminal under the control of the enable signal terminal.

When the display panel is in the power-on stage, the signal input by the enable signal terminal is at the high level.

The common voltage regulating method provided in the present embodiment is applied to the common voltage regulating circuit described with reference to FIG. 2, and the implementation principle and the effect are similar, which are not described herein again.

In some implementations, the common voltage regulating method provided by the present embodiment further includes a step S2.

In step S2, when the display panel is in the display stage, the first regulating sub-circuit provides the signal from the first signal input terminal to the first signal output terminal under the control of the enable signal terminal.

When the display panel is in the display stage, the signal input by the enable signal terminal is at the low level.

In some implementation, the common voltage regulating method provided by the present embodiment further includes steps S3 and S4.

In step S3, the identification sub-circuit identifies whether the display panel is in the power-off stage according to the clock signals of the N clock signal terminals, and outputs the control signal when the display panel is in the power-off stage.

Specifically, the step S3 includes: the identification sub-circuit judges whether all the clock signals of the N clock signal terminals are at the high level, and when the display panel is in the power-off stage, outputs the control signal in response to that all the clock signals of the N clock signal terminals are at the high level.

The control signal is a high level signal.

In step S4, the second regulating sub-circuit regulates the signal from the third signal input terminal according to the signals of the second signal input terminal, the third signal input terminal, and the reference signal terminal under the control of the control signal, until the voltage difference between the regulated signal of the third signal input terminal and the signal of the second signal input terminal is smaller than or equal to the voltage of the signal of the reference signal terminal, and provides the regulated signal of the third signal input terminal to the second signal output terminal.

Specifically, the step S4 includes: the second regulating sub-circuit is started to operate under the control of the control signal, obtains the voltage difference according to the voltages of the signals of the second signal input terminal and the third signal input terminal, compares the voltage difference with the voltage of the signal of the reference signal terminal, and regulates the signal of the third signal input terminal according to the voltage difference in response to that the voltage difference is greater than the voltage of the signal of the reference signal terminal, until the voltage difference between the regulated signal of the third signal input terminal and the signal of the second signal input terminal is smaller than or equal to the voltage of the signal of the reference signal terminal, and outputs the regulated signal from the third signal input terminal to the second signal output terminal.

Figure 7:
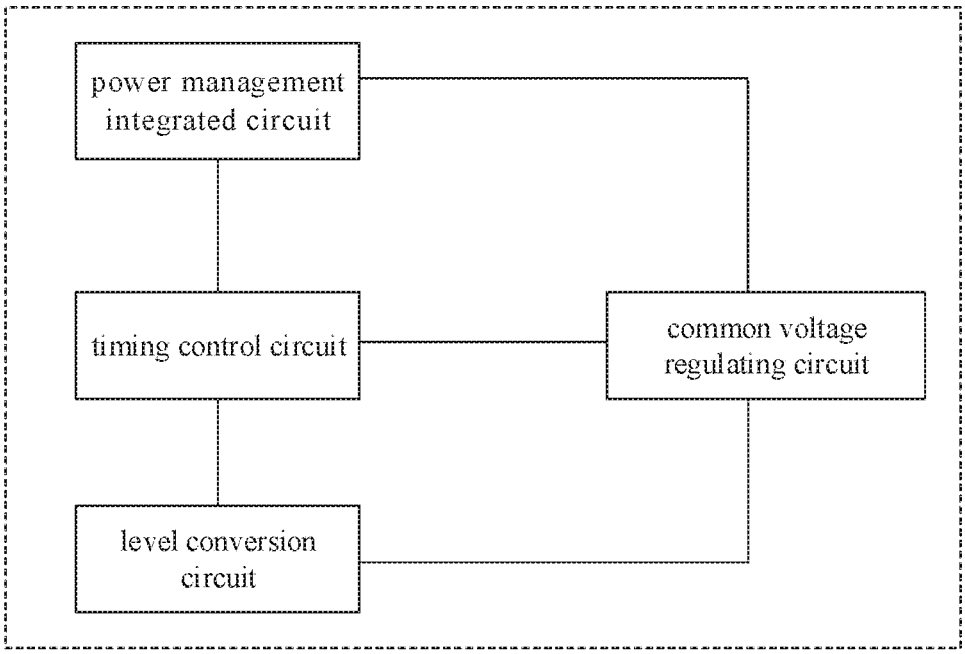
FIG. 7 is a schematic structural diagram of a display driving circuit according to an embodiment of the present disclosure.

Based on the same inventive concept, an embodiment of the present disclosure further provides a display driving circuit, and FIG. 7 is a schematic structural diagram of the display driving circuit provided in the embodiment of the present disclosure, as shown in FIG. 7, the display driving circuit provided in the embodiment of the present disclosure includes: a timing control circuit, a level conversion circuit, a power management integrated circuit and a common voltage regulating circuit.

As shown in FIG. 7, the common voltage regulating circuit is coupled to the timing control circuit, the level conversion circuit, and the power management integrated circuit, respectively.

In addition, it should be noted that the display driving circuit further includes: a gate driving circuit coupled with the timing control circuit and the level conversion circuit, and a source driving circuit coupled with the power management integrated circuit.

In some implementations, the timing control circuit is coupled with the enable signal terminal and configured to provide a signal to the enable signal terminal; the level conversion circuit is coupled with the N clock signal terminals and configured to provide clock signals for the N clock signal terminals; and the power management integrated circuit is coupled with the first signal input terminal and the second signal input terminal, and configured to provide the first signal input terminal with the signal to be provided to the common electrode in the display stage of the display panel, and further configured to provide the second signal input terminal with the signal to be provided to the pixel electrode in the power-on stage and the power-off stage of the display panel.

Figure 8:
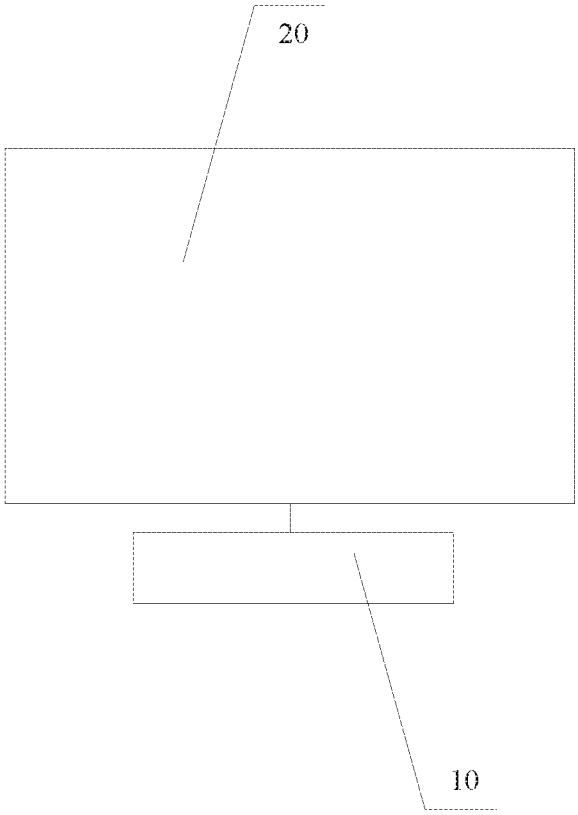
FIG. 8 is a schematic structural diagram of a display device according to an embodiment of the present disclosure.

Based on the inventive concept of the above embodiments, an embodiment of the present disclosure further provides a display device, FIG. 8 is a schematic structural diagram of the display device provided in the embodiment of the present disclosure, and as shown in FIG. 8, the display device provided in the embodiment of the present disclosure includes a display driving circuit 10.

The display device provided in the embodiment of the present disclosure further includes: a display panel 20 coupled with the display driving circuit 10, the display driving circuit 10 is configured to drive the display panel 20 to display, and the display driving circuit is the display driving circuit provided in the above embodiment, and the implementation principle and effect thereof are similar, and are not described herein again.

Specifically, the display device may be any product or component having a display function, such as a mobile phone, a tablet computer, a television, a display, a notebook computer, a digital photo frame, and a navigator, which is not limited in the embodiment of the present disclosure.

It should be noted that the display device described in the embodiment of the present disclosure may be of a Twisted Nematic (TN) mode, a Vertical Alignment (VA) mode, an In-plane Switching (IPS) mode, or an advanced super Dimension Switching (ADS) mode, which is not limited in any way by the present disclosure.

The term "power-on stage" in the present disclosure indicates a stage during which the display panel is being powered on, the term "power-off stage" in the present disclosure indicates a stage during which the display panel is being powered off, and the term "display stage" in the present disclosure indicates a stage during which the display panel is displaying.

The drawings of the embodiments of the disclosure only relate to the structures related to the embodiments of the disclosure, and other structures can refer to common designs.

Without conflict, features of the embodiments of the present disclosure may be combined with each other to obtain new embodiments.

Although the embodiments disclosed in the present disclosure are described above, the descriptions are only for the purpose of understanding the present disclosure, and are not intended to limit the present disclosure. It should be understood by those skilled in the art that various changes in form and details may be made therein without departing from the spirit and scope of the present disclosure, and that the scope of the present disclosure is limited only by the appended claims.

The invention claimed is:

1. A common voltage regulating circuit for regulating a common voltage of a display panel, wherein the display panel comprises a common electrode and a pixel electrode, the common voltage regulating circuit comprises a first regulating sub-circuit, an identification sub-circuit and a second regulating sub-circuit, wherein the first regulating sub-circuit is respectively coupled with an enable signal terminal, a first signal input terminal, a second signal input terminal and a first signal output terminal, and is configured to provide a signal from the second signal input terminal to the first signal output terminal under the control of the enable signal terminal in a power-on stage of the display panel;

the first signal input terminal is configured to input a signal to be provided to the common electrode in a display stage of the display panel, the second signal input terminal is configured to input a signal to be provided to the pixel electrode in the power-on stage of the display panel, and the first signal output terminal is coupled to the common electrode, the second signal input terminal is further configured to input a signal to be provided to the pixel electrode in a power-off stage of the display panel, the identification sub-circuit is respectively coupled with N clock signal terminals and is configured to identify whether the display panel is in the power-off stage according to clock signals of the N clock signal terminals, and output a control signal in response to an identification result indicating that the display panel is in the power-off stage, wherein N is an integer larger than or equal to 2;

the second regulating sub-circuit is respectively coupled to the identification sub-circuit, the second signal input terminal, a third signal input terminal, a reference signal terminal and a second signal output terminal, and is configured to regulate, under the control of the control signal, a signal from the third signal input terminal according to signals from the second signal input terminal, the third signal input terminal and the reference singal terminal, until a voltage difference between the regulated signal from the third signal input terminal and the signal from the second signal input terminal is less than or equal to a voltage of a signal from the reference signal terminal, and is further configured to provide the regulated signal from the third signal input terminal to the second signal output terminal; and the common electrode is coupled with the third signal input terminal and the second signal output terminal, respectively.

2. The common voltage regulating circuit according to claim 1, wherein the first regulating sub-circuit is further configured to provide, under the control of the enable signal terminal, a signal from the first signal input terminal to the first signal output terminal in the display stage of the display panel.

3. The common voltage regulating circuit according to claim 2, further comprising: an identification sub-circuit and a second regulating sub-circuit, wherein the second signal input terminal is further configured to input a signal to be provided to the pixel electrode in a power-off stage of the display panel, the identification sub-circuit is respectively coupled with N clock signal terminals and is configured to identify whether the display panel is in the power-off stage according to clock signals of the N clock signal terminals, and output a control signal in response to an identification result indicating that the display panel is in the power-off stage, wherein N is an integer larger than or equal to 2;

the second regulating sub-circuit is respectively coupled to the identification sub-circuit, the second signal input terminal, a third signal input terminal, a reference signal terminal and a second signal output terminal, and is configured to regulate, under the control of the control signal, a signal from the third signal input terminal according to signals from the second signal input terminal, the third signal input terminal and the reference signal terminal, until a voltage difference between the regulated signal from the third signal input terminal and the signal from the second signal input terminal is less than or equal to a voltage of a signal from the reference signal terminal, and is further configured to provide the regulated signal from the third signal input terminal to the second signal output terminal;

the common electrode is coupled with the third signal input terminal and the second signal output terminal, respectively.

4. The common voltage regulating circuit according to claim 3, wherein the first regulating sub-circuit is coupled to the identification sub-circuit and configured to output no signal under the control of the control signal.

5. The common voltage regulating circuit according to claim 4, wherein the first regulating sub-circuit comprises a data selector, wherein, the data selector comprises a first control terminal, a first input terminal, a second input terminal, a third input terminal and a first output terminal, and the first control terminal, the first input terminal, the second input terminal and the third input terminal of the data selector are respectively coupled with the identification sub-circuit, the enable signal terminal, the first signal input terminal and the second signal input terminal, and the first output terminal of the data selector is coupled with the first signal output terminal.

6. The common voltage regulating circuit according to claim 1, wherein the first regulating sub-circuit is coupled to the identification sub-circuit and configured to output no signal under the control of the control signal.

7. The common voltage regulating circuit according to claim 6, wherein the first regulating sub-circuit comprises a data selector, wherein, the data selector comprises a first control terminal, a first input terminal, a second input terminal, a third input terminal and a first output terminal, and the first control terminal, the first input terminal, the second input terminal and the third input terminal of the data selector are respectively coupled with the identification sub-circuit, the enable signal terminal, the first signal input terminal and the second signal input terminal, and the first output terminal of the data selector is coupled with the first signal output terminal.

8. The common voltage regulating circuit according to claim 7, wherein the identification sub-circuit comprises an AND gate circuit, wherein the AND gate circuit comprises a plurality of input terminals and one output terminal, the input terminals of the AND gate circuit are respectively coupled with the N clock signal terminals, and the output terminal of the AND gate circuit is respectively coupled with the control terminal of the data selector and the second regulating sub-circuit.

9. The common voltage regulating circuit according to claim 7, wherein the second regulating sub-circuit comprises a subtracter, a comparator and a voltage regulator;

the subtractor comprises a second control terminal, a fourth input terminal, a fifth input terminal and a second output terminal, and the comparator comprises a sixth input terminal, a seventh input terminal and a third output terminal; the voltage regulator comprises an eighth input terminal, a ninth input terminal, a fourth output terminal and a fifth output terminal, the second control terminal of the subtracter is coupled with the output terminal of the AND gate circuit and is configured to receive the control signal output by the AND gate circuit; the fourth input terminal of the subtractor is coupled to the second signal input terminal, the fifth input terminal of the subtractor is coupled to the third signal input terminal, the second output terminal of the subtractor is coupled to the sixth input terminal of the comparator, and the subtractor is configured to be started to operate under the control of the control signal;

the seventh input terminal of the comparator is coupled with the reference signal terminal, and the third output terminal of the comparator is coupled with the voltage regulator;

the eighth input terminal of the voltage regulator is coupled with the second output terminal of the subtracter, the ninth input terminal of the voltage regulator is coupled with the third output terminal of the comparator, the fourth output terminal of the voltage regulator is coupled with the third signal input terminal, and the fifth output terminal of the voltage regulator is coupled with the second signal output terminal.

10. A display driving circuit, comprising: a timing control circuit, a level conversion circuit, a power management integrated circuit, and the common voltage regulating circuit according to claim 1, the common voltage regulating circuit is respectively coupled with the timing control circuit, the level conversion circuit and the power management integrated circuit.

11. The display driving circuit according to claim 10, wherein the timing control circuit is coupled to the enable signal terminal for providing a signal to the enable signal terminal; the level conversion circuit is coupled with N clock signal terminals and is configured to provide clock signals to the N clock signal terminals; the power management integrated circuit is coupled to the first signal input terminal and the second signal input terminal, and is configured to input, to the first signal input terminal, a signal to be provided to the common electrode in a display stage of the display panel, and is further configured to input a signal to be provided to the pixel electrode in a power-on stage and a power-off stage of the display panel.

12. A display device, comprising the display driving circuit according to claim 11.

13. A display device, comprising the display driving circuit according to claim 10.

14. A common voltage regulating method applied to the common voltage regulating circuit according to claim 1, comprising:

providing, by the first regulating sub-circuit, a signal from the second signal input terminal to the first signal output terminal under the control of the enable signal terminal in power-on stage of the display panel.

15. The common voltage regulating method according to claim 14, further comprising:

providing, by the first regulating sub-circuit, a signal from the first signal input terminal to the first signal output terminal under the control of the enable signal terminal in the display stage of the display panel.

16. The common voltage regulating method according to claim 15, wherein the common voltage regulating circuit further comprising an identification sub-circuit and a second regulating sub-circuit, the second signal input terminal is further configured to input a signal to be provided to the pixel electrode in the power-off stage of the display panel; the identification sub-circuit is respectively coupled with N clock signal terminals, wherein N is an integer larger than or equal to 2; the second regulating sub-circuit is respectively coupled with the identification sub-circuit, the second signal input terminal, the third signal input terminal, the reference signal terminal and the second signal output terminal, the common voltage regulating method further comprising:

identifying, by the identification sub-circuit, whether the display panel is in the power-off stage, according to clock signals of the N clock signal terminals;

outputting, by the identification sub-circuit, a control signal in the power-off stage of the display panel, so that the first regulating sub-circuit outputs no signal under the control of the control signal; and regulating, by the second regulating sub-circuit, under the control of the control signal, the signal from the third signal input terminal according to the signals from the second signal input terminal, the third signal input terminal and the reference signal terminal, until a voltage difference between the regulated signal from the third signal input terminal and the signal from the second signal input terminal is less than or equal to a voltage of the signal from the reference signal terminal, and outputting, by the second regulating sub-circuit, the regulated signal from the third signal input terminal to the second signal output terminal.

17. The common voltage regulating method according to claim 14, wherein the common voltage regulating circuit further comprising an identification sub-circuit and a second regulating sub-circuit, the second signal input terminal is further configured to input a signal to be provided to the pixel electrode in the power-off stage of the display panel; the identification sub-circuit is respectively coupled with N clock signal terminals, wherein N is an integer larger than or equal to 2; the second regulating sub-circuit is respectively coupled with the identification sub-circuit, the second signal input terminal, the third signal input terminal, the reference signal terminal and the second signal output terminal, the common voltage regulating method further comprising:

identifying, by the identification sub-circuit, whether the display panel is in the power-off stage, according to clock signals of the N clock signal terminals;

outputting, by the identification sub-circuit, a control signal in the power-off stage of the display panel, so that the first regulating sub-circuit outputs no signal under the control of the control signal; and regulating, by the second regulating sub-circuit, under the control of the control signal, the signal from the third signal input terminal according to the signals from the second signal input terminal, the third signal input terminal and the reference signal terminal, until a voltage difference between the regulated signal from the third signal input terminal and the signal from the second signal input terminal is less than or equal to a voltage of the signal from the reference signal terminal, and outputting, by the second regulating sub-circuit, the regulated signal from the third signal input terminal to the second signal output terminal.

18. The common voltage regulating method according to claim 17, wherein the identifying, by the identification sub-circuit, whether the display panel is in the power-off stage, according to the clock signals of the N clock signal terminals comprises:

judging, by the identification sub-circuit, whether all the clock signals of the N clock signal terminals are at a high level, and in response to that all the clock signals of the N clock signal terminals are at the high level, the display panel is in the power-off stage.

19. The common voltage regulating method according to claim 17, wherein the regulating, by the second regulating sub-circuit, under the control of the control signal, the signal from the third signal input terminal according to the signals from the second signal input terminal, the third signal input terminal and the reference signal terminal comprises:

making the second regulating sub-circuit start to operate under the control of the control signal, obtaining the voltage difference according to the voltages of the signals of the second signal input terminal and the third signal input terminal, comparing the voltage difference with the voltage of the signal of the reference signal terminal, and regulating, by the second regulating sub-circuit, the signal from the third signal input terminal according to the voltage difference in response to that the voltage difference is larger than the voltage of the signal of the reference signal terminal.

* * * * *